United States Patent [19]

Stotts

[11] Patent Number: 4,735,544

[45] Date of Patent: Apr. 5, 1988

[54] PORTABLE BALL RETRIEVER, HOLDER AND CARRIER APPARATUS

[76] Inventor: Dennis K. Stotts, 2102 W. 21st, Emporia, Kans. 66801

[21] Appl. No.: 846,110

[22] Filed: Mar. 31, 1986

[51] Int. Cl.[4] ..... B60P 1/00

[52] U.S. Cl. ..... 414/440

[58] Field of Search ..... 414/440, 434, 439, 441; 294/19.2; 273/29 R, 32 B, 397

[56] References Cited

U.S. PATENT DOCUMENTS

| | | | |
|---|---|---|---|
| 3,102,647 | 9/1963 | Bonney | 414/440 |
| 4,077,533 | 3/1978 | Meyer | 414/440 |
| 4,252,490 | 2/1981 | Keller | 414/434 |
| 4,593,519 | 6/1986 | Kimball | 414/440 X |

*Primary Examiner*—Robert J. Spar
*Assistant Examiner*—Stuart J. Millman
*Attorney, Agent, or Firm*—Phillip A. Rein

[57] ABSTRACT

This invention relates to a portable ball retriever, holder, and carrier apparatus operable to (1) pick-up and retrieve ball members from a support surface; (2) hold the ball members in a container member in an elevated condition; and (3) be folded into a compact condition for transport and/or storage. The portable ball retriever, holder, and carrier apparatus includes a main support frame assembly; a support and power drive assembly operable to provide mechanical power drive for a ball member retrieving function; a ball pick-up assembly having a rotatable cylinder member to pick-up the ball members and carry same upwardly and laterally; a ball container assembly mounted on the main support frame assembly to receive ball members therein; and an actuator handle assembly which is movable to various positions. The ball pick-up assembly includes a main retriever housing having a rotatable pick-up cylinder assembly therein. The pick-up cylinder assembly includes a deformable cylinder member operable to receive ball members thereagainst and being deformed to grasp the ball members for subsequent movement upwardly and laterally. The ball container assembly includes a container member which is movable from a horizontal position to receive ball members therein to an elevated holder condition position to hold the ball members for usage. The actuator handle assembly is provided with a collapsible actuator handle member for use in (1) an extended rigid position for pushing the entire carrier apparatus; and (2) foldable into a compact position over the ball container assembly for storage and transport purposes.

12 Claims, 3 Drawing Sheets

FIG. 4
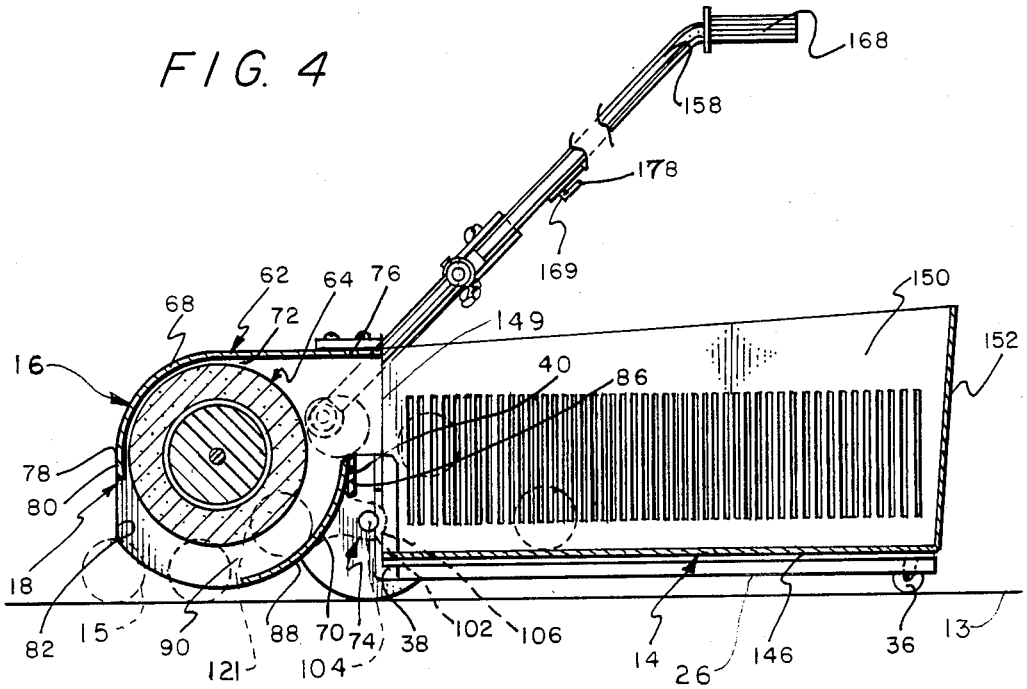
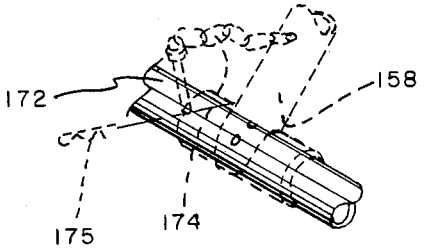
FIG. 7
FIG. 5
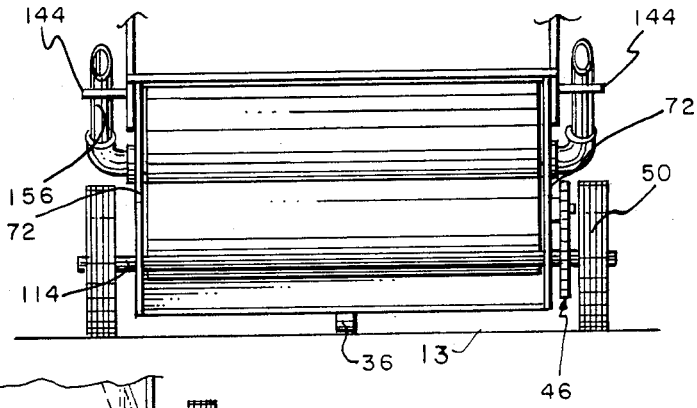
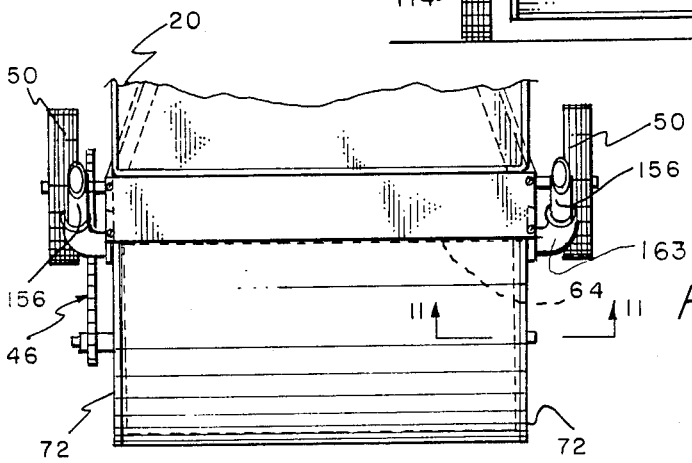
FIG. 6

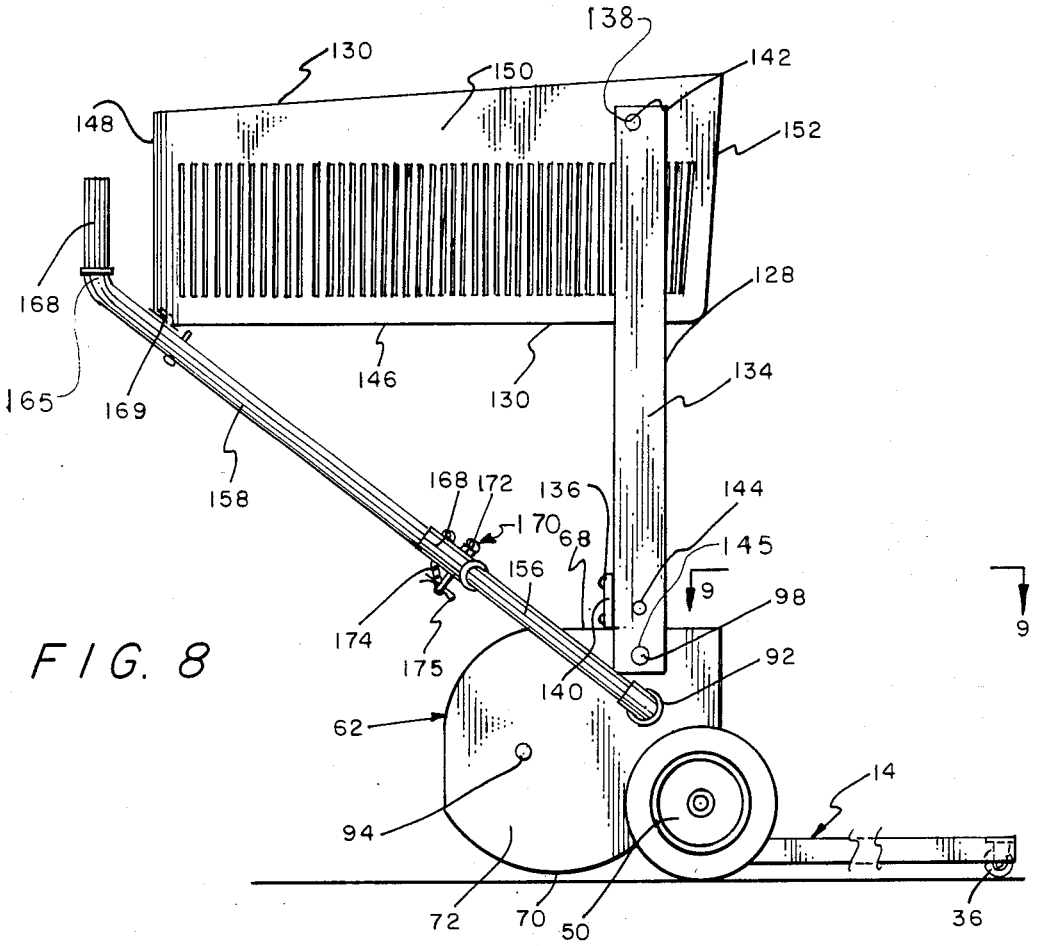
FIG. 8
FIG. 9
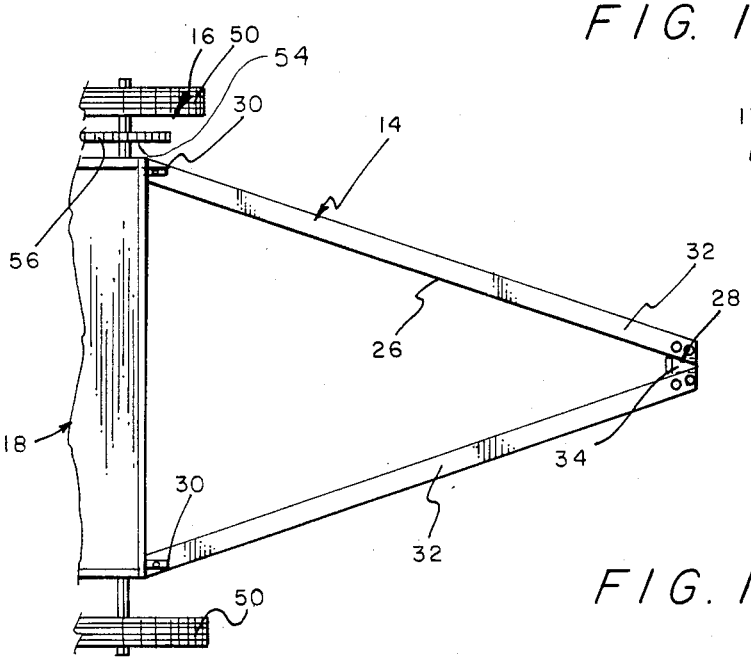
FIG. 10
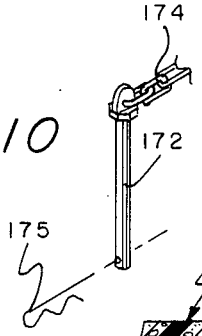
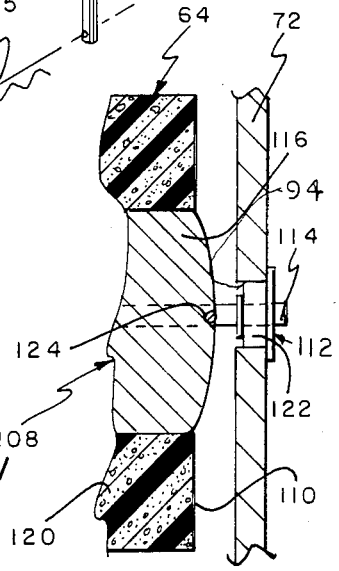
FIG. 11

PORTABLE BALL RETRIEVER, HOLDER AND CARRIER APPARATUS

PRIOR ART

A patentability investigation on the invention set forth herein revealed the following U.S. patents:

| U.S. Pat. No. | Invention | Inventor |
|---|---|---|
| 3,371,950 | TENNIS BALL RETRIEVER AND STORAGE UNIT | Stap |
| 3,593,868 | TENNIS BALL RETRIEVER | Folz |
| 3,804,449 | TENNIS BALL RETRIEVER | Falitz |
| 3,902,749 | TENNIS BALL RETRIEVER WITH HINGED GATE | Falitz |
| 4,063,769 | BALL RETRIEVER | Zimmer |
| 4,318,654 | TENNIS BALL RETRIEVING DEVICE | Lee |

The Stap patent discloses a tennis ball retriever and storage device having a grid on the lower surface thereof slightly smaller than that of an individual ball member. The entire structure is pressed downwardly over the ball members so as to enclose same and, on deformation of the ball member, it moves upwardly into a storage or container area. This type of structure is common knowledge in the prior art.

The Zimmer patent discloses a ball retriever device utilizing the noted feature of deformation of a ball member which additionally causes deformation of a screen member to allow the ball member to mcved inwardly and upwardly into a storage container.

The Lee patent discloses a lawn mower type structure being operable to grasp a tennis ball member between rotating disc members before the ball member is dislodged by a ball extractor member and moving into a storage area.

The two (2) Falitz patents disclose tennis ball retriever structures resembling a lawn mower and deforming the balls before moving into a storage area.

The Folz patent discloses an elaborate tennis ball retriever structure having arm members to direct the ball members centrally into a rotating brush structure which acts to engage the ball members, flip the ball members upwardly against a shield member, and then downwardly to a storage container. This is a rather elaborate and expensive structure.

The invention herein is deemed to have numerous new and novel features over the aforementioned United States patents.

PREFERRED EMBODIMENT OF THE INVENTION

In one preferred embodiment of this invention, a portable ball retriever, holder, and carrier apparatus includes (1) a main support frame assembly; (2) a support and power drive assembly connected to the main support frame assembly; (3) a ball pick-up assembly mounted on the support and power drive assembly; (4) a ball container assembly mounted on the main support frame assembly and operable to receive ball members from the ball pick-up assembly; and (5) an actuator handle assembly connected to the ball pick-up assembly. The main support frame assembly is provided with a base support assembly mounted on a base support wheel assembly so as to be movable and supported on a ground surface. The support and power drive assembly includes a power drive assembly connected to a wheel drive assembly whereupon the movement of support wheels along the support surface provides the power to actuate the ball pick-up assembly. The ball pick-up assembly includes a main retriever housing having a pick-up cylinder assembly rotatably mounted therein. The pick-up cylinder assembly is provided with a cylinder support assembly having an outer resilient cover member to receive ball members therein and hold them against the main retriever housing for movement into the ball container assembly. The ball container assembly includes a container support having a container member pivotally connected thereto. The container member is pivotal from a lower receiving position to receive ball members from the ball pick-up assembly and, additionally, movable to an elevated position to be supported on the actuator handle assembly. In the elevated position, the ball members can be easily grasped by the person using same while practicing tennis and the like. The actuator handle assembly includes an actuator handle member pivotally connected to a support yoke member which, in turn, is pivotally connected to the main retriever assembly. The actuator handle assembly is operable in a rigid extended position to provide means for pushing the entire ball retriever, holder, and carrier apparatus which rotates the pick-up cylinder assembly. In a second position, the actuator handle assembly member is folded into a compact position adjacent to the ball pick-up assembly and the ball container assembly so as to be readily grasped, and easily transported, and carried in a trunk of a vehicle.

OBJECTS OF THE INVENTION

One object of this invention is to provide a portable ball retriever, holder, and carrier apparatus which is lightweight; foldable into a compact, transport and storage condition; and having a ball container assembly which is movable from a ball pick-up and storage position, to an elevated position for holding ball members for a person utilizing same.

One further object of this invention is provide a portable ball retriever, holder, and carrier apparatus operable to (1) retrieve ball members scattered about on a ground surface by moving the apparatus into engagement with the ball members; (2) storing the tennis balls in a ball container assembly when in non-use; and (3) holding the ball container assembly in an elevated position with the ball members therein available to be readily grasped and utilized by an adjacent ball player person.

Still, another object of this invention is to provide a portable ball retriever, holder, and carrier apparatus including ball pick-up assembly having a ball pick-up cylinder assembly mounted within a main retriever assembly whereupon the pick-up cylinder assembly includes a resilient cover member adapted to contact tennis balls or the like to be conveyed inwardly and upwardly into a ball container assembly.

One other object of this invention is to provide a portable ball retriever, holder, and carrier apparatus including a ball pick-up assembly having a pick-up cylinder assembly mounted within a main retriever assembly with the pick-up cylinder assembly having an outer resilient cover member which can be disassembled and replaced when necessary due to maintenance and wear thereon.

Still, another object of this invention is to provide a portable ball retriever, holder, and carrier apparatus which is sturdy in construction; readily portable; and efficient and effective in picking up ball members for conveyance into a ball container member for subsequent use thereof.

Various other objects, advantages, and features of this invention will become apparent to those skilled in the art from the following discussion, taken in conjunction with the accompanying drawings, in which:

FIGURES OF THE INVENTION

FIG. 4 is a sectional view taken along line 4—4 in FIG. 2;

FIG. 5 is a sectional view taken along line 5—5 in FIG. 3;

FIG. 6 is a fragmentary foreshortened top elevational view of the portable ball retriever, holder, and carrier apparatus of this invention;

FIG. 7 is a foreshortened perspective view of a portion of the actuator handle assembly of the portable ball retriever, holder, and carrier apparatus of this invention illustrating movement towards a folded condition in dotted lines;

FIG. 8 is a side elevational view of the portable ball retriever, holder, and carrier apparatus of this invention illustrated in the elevated ball holder position;

FIG. 9 is a foreshortened view taken along line 9—9 in FIG. 8;

FIG. 10 is an exploded perspective view illustrating a lock pin assembly of the portable ball retriever, holder, and carrier apparatus of this invention; and FIG. 11 is an enlarged fragmentary sectional view taken along line 11—11 in FIG. 6.

Figure 1:
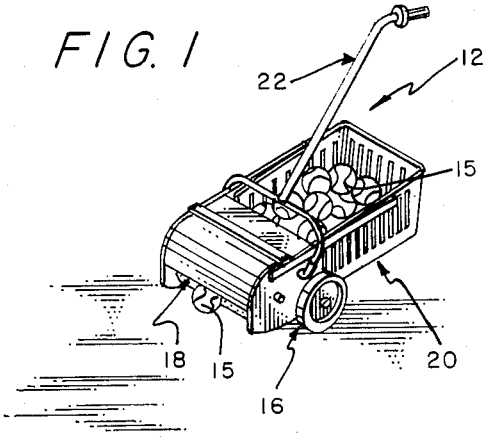
FIG. 1 is a perspective view of a portable ball retriever, holder, and carrier apparatus of this invention illustrated on a support surface for retrieving tennis balls through a front portion to be transported upwardly and rearwardly into a container member.
Figure 2:
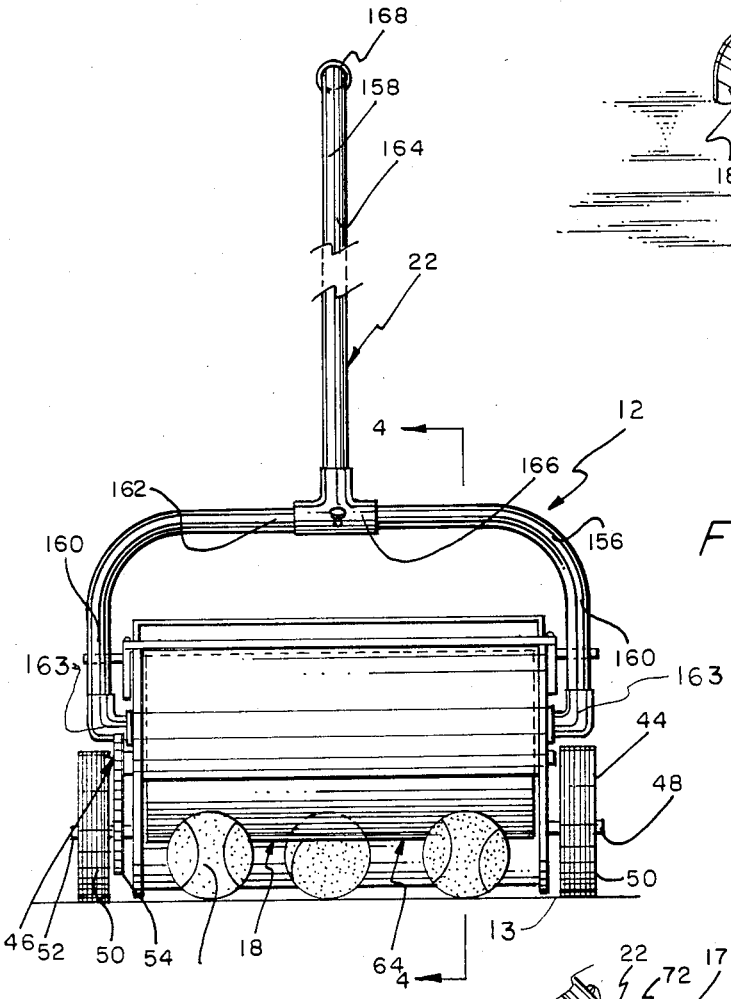
FIG. 2 is a front elevational view of the portable ball retriever, holder, and carrier apparatus of this invention having ball members illustrated as entering the front portion thereof.

The following in a discussion and description of preferred specific embodiments of the new portable ball retriever, holder, and carrier apparatus of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Figure 3:
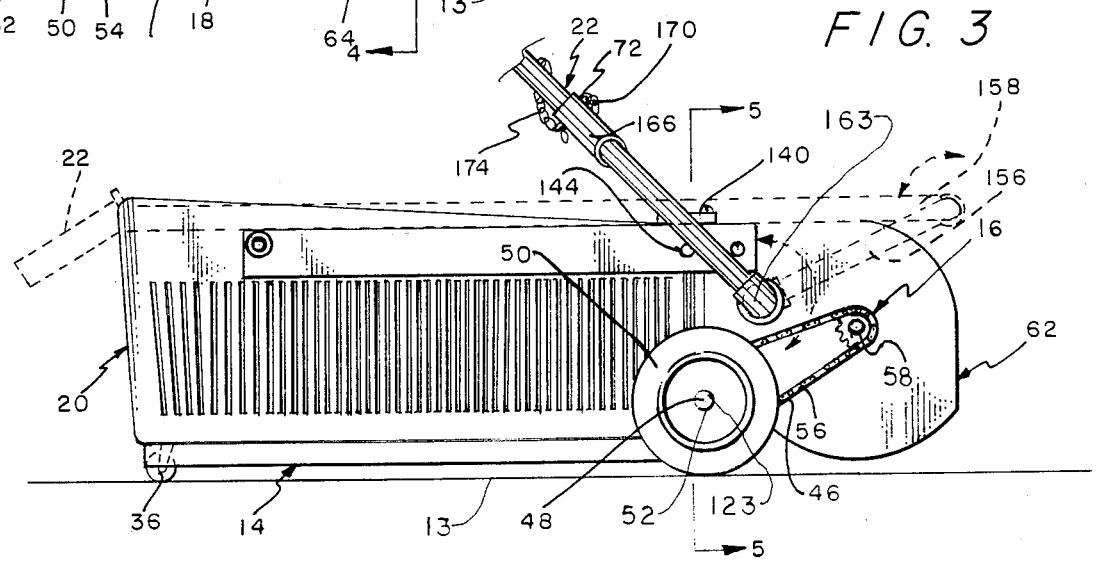
FIG. 3 is a foreshortened side elevational view of the portable ball retriever, holder, and carrier apparatus of this invention having an actuator handle assembly illustrated in a folded condition in dotted lines.

Referring to the drawings in detail, and in particular to FIG. 1, a portable ball retriever, holder, and carrier apparatus, indicated generally at 12, is utilized in this condition to be pushed along a support surface 13 in order to contact and grasp ball members such as tennis ball members 15. The ball members 15 are grasped and moved in arcuate path upwardly to be placed within a container structure of this invention as will be described. The condition for "ball retrieving" is indicated in FIG. 1 but the invention has further embodiments of (1) being a ball holder to place a container structure in an elevated position as shown in FIG. 8; and (2) ball carrier position as illustrated in FIG. 3 with the handle assembly in a folded storage condition as indicated in dotted lines. The operation of these three (3) various positions of the invention will be described in detail.

The portable ball retriever, holder, and carrier apparatus 12 includes (1) a main support frame assembly 14; (2) a support and power drive assembly 16 positioned forwardly and connected to the main support frame assembly 14; (3) a ball pick-up assembly 18 mounted forwardly of the support and power drive assembly 16; (4) a ball container assembly 20 operable to hold the ball members 15 therein and mounted adjacent but rearwardly of the ball pick-up assembly 18; and (5) an actuator handle assembly 22 connected to the ball pick-up assembly 18 and operable to be usable in three (3) various functions as will be explained.

The main support frame assembly 14 includes (1) a base support assembly 26; (2) a base support wheel assembly 28 connected to the base support assembly 26; and (3) spaced vertical support arms 30 connected to the base support assembly 26. The base support assembly 26 includes a pair of divergent support members 32 as noted in FIG. 9 with the adjacent ends thereof interconnected by a connector plate member 34. The support members 32 can be constructed of a square tubular material or the like which provides support for the ball container assembly 20 when in the retrieving and carrier positions as will be explained.

The base support wheel assembly 28 includes an adjustable caster wheel member 36 which is rotatable 360 degrees so as to easily direct the entire portable ball retriever, holder, and carrier apparatus 12 in a ball member retrieving operation.

As noted in FIG. 4, the vertical support arms 30 includes spaced, parallel, upright support members 38 which are interconnected by a cylinder support member 40 to provide a rigid connection between the base support assembly 26 and the support and power drive assembly 16 as will be noted.

The support and power drive assembly 16 includes a wheel drive assembly 44 operably connected to a power drive assembly 46. The wheel drive assembly 44 includes a main support shaft or axle 48 having wheel members 50 secured to outer ends thereof and anchored to the support shaft 48 through anchor nut members 52. The wheel members 50 resemble lawn mower type wheel members and being rotatable to drive the power drive assembly 46 which operates to actuate the ball pick-up assembly 18 as will be explained.

The power drive assembly 46 includes a drive sprocket 54 secured to the adjacent wheel member 50 so as to be rotatable therewith; and a drive chain member 56 trained about the drive sprocket member 54 and a driven sprocket member 58. The driven sprocket member 58 is anchored to a support shaft of the ball pick-up assembly 18 as will be noted.

The ball pick-up assembly 18 includes a main retriever housing 62 which is connected through the cylinder housing support arm 40 to the main support frame assembly 14; and a ball pick-up cylinder assembly 64 which is mounted within the main retriever housing 62 and driven through the power drive assembly 46.

The main retriever housing 62 includes (1) an arcuate top wall member 68; (2) an arcuate bottom wall member 70; (3) parallel, spaced side wall members 72 integral with the top wall member 68 and the bottom wall member 70; and (4) a connector assembly 74 operable to connect the retriever housing 62 to the main support frame assembly 14.

The arcuate top wall member 68 is formed with a horizontal wall section 76 integral with a curved wall section 78 having a forward portion integral with a vertical wall section 80 on an outer end thereof. An outer edge of the vertical wall section 80 is elevated a distance off the support surface 13 so as to define a ball entrance opening 82 where the ball members 15 enter as clearly noted in FIG. 4.

The arcuate bottom wall member 70 is provided with a vertical connector wall section 86 integral with a bottom wall section 88. It is noted that an outer edge of the arcuate bottom wall section 88 defines a ball entrance opening 90 for the ball members 15 to enter. The ball members 15 are engagable with an upper surface of the arcuate bottom wall 70 and the pick-up cylinder assembly 64 in a manner to be explained.

The parallel side wall members 72 are extended in spaced vertical planes so as to provide the lateral limitations of the ball entrance openings 82 and 90. Each side wall member 72 is provided with (1) handle support openings 92; (2) cylinder shaft openings 94; and (3) basket support openings 98. The functions of these openings will be explained.

The connector assembly 74 includes a pair of spaced parallel support yoke members 102. Each support yoke member 102 is provided with a yoke body 104 having a shaft axle opening 106 therein. The shaft axle opening 106 is operable to receive the support shaft or axle 48 therethrough to provide rigid support to the main support frame assembly 14.

The pick-up cylinder assembly 64, as noted in FIG. 11, includes (1) a cylindrical support assembly 108; (2) a ball-pick-up cylinder member 110; and (3) a cylinder connector assembly 112. The cylindrical support assembly 108 includes a cylindrical drive shaft 114 having an inner support cylinder 116 connected thereto. The cylindrical drive shaft 114 has opposite ends thereof mounted and supported within the cylinder shaft openings 94 of the side wall members 72. Additionally, one end of the cylinder drive shaft 114 extends a distance outwardly of the right side wall member 72 having the driven sprocket member 58 connected thereto which receives the power drive for the entire pick-up cylinder assembly 64. The inner support cylinder 116 is preferably constructed of a rigid material adapted to support the pick-up cylinder member 110 thereon.

The inner support cylinder 116 is provided with an outer sleeve member 120 which is formed of a plastic foam type material which is selected to have the specific capability of being deformed when receiving the ball members 15 thereagainst. As best shown in FIG. 4, the deformity in the sleeve member 120 is indicated by a curved portion 121.

The cylinder connector assembly 112 includes a shaft bearing member 122 mounted on each opposite end of the cylindrical drive shaft 114 in the openings 94. A lock cap 123 is operable to retain the shaft bearing members 122 on the drive shaft 114. Additionally, a cylinder lock pin 124, as noted in FIG. 11, extends through a hole in the cylindrical drive shaft 114 so as to maintain the inner support cylinder 116 in a predetermined axial location along the cylinder drive shaft 114. The cylinder drive shaft 114 is removed from the pick-up cylinder assembly 64 so it can be removed for repair and maintenance. Normally, the main repair and maintenance necessary would be the replacement of the foam sleeve member 120 which may be worn after a long period of usage.

The ball container assembly 20 includes a main container support assembly 128 which is connected at a lower end portion to the main retriever housing 62 and at an upper portion to a container member 130. The container support assembly 128 includes (1) a pair of spaced container support arm members 134; (2) a container support cross arm member 136 interconnected to the container support arm members 134; and (3) a connector assembly 138 to pivotally connect the support arm members 134 to the main retriever housing 62.

The container support cross arm member 136 is a support strap member 140 connected as by rivets, bolts, or the like to the support arm members 134.

The connector assembly 138 includes (1) container pivot pins 142 to allow pivotal movement of the container member 130; (2) retriever housing stop pins 144 operable to be engagable by the actuator handle assembly 22 for reasons to be explained; and (3) a pair of pivot pins 145 are mounted within the respective basket support openings 98 in the side wall members 72 of the main retriever housing 62 to permit pivotal movement of the support arm members 134.

The container member 130 includes a bottom wall section 146; a front wall section 148; parallel opposed side wall sections 150; and an inclined rearwall section 152. It is noted that the numerous wall sections are integral with each other so as to form a substantially rectangular box shape with an open top to receive the ball members 15 therein after retrieving; holding in an elevated position; and storage as will be explained.

The actuator handle assembly 22 includes a u-shaped support yoke member 156 pivotally connected at a lower end thereof to the main retriever housing 62; and an actuator handle member 158 pivotally connected to the support yoke member 156.

The support yoke member 156 is provided with connector legs 160 integral with a top yoke section 162. The connector legs 160 are secured to with connector elbows 163 at the lower end thereof which are pivotally mounted in the respective handle support openings 92.

The actuator handle member 158 includes (1) a main handle body 164; (2) a connector tee section 166 secured to a lower end of the main handle body 164 and pivotally connected to the top yoke section 162; (3) a handle grip section 168; and (4) a container support hook 169 thereon. The main handle body 164 is of a tubular construction including an outer curved portion 165 having the handle grip section 168 mounted thereon.

The container tee section 166 is pivotally mounted on the top yoke section 162 but held in a locked position, as noted in FIG. 8, by a lock pin assembly 170.

The lock pin assembly 170 includes a lock pin member 172; a retainer chain assembly 174 having one end connected to the lock pin member 172 and the other end secured to connector tee section 166; and a retainer clip member 175 engagable with the lock pin member 172 to prevent its unintentional axial movement within aligned holes through the connector tee section 166 and the top yoke section 162. The lock pin member 172 locks the actuator handle assembly 22 in the extended condition of FIGS. 1 and 8 and in the folded condition as shown in dotted lines in FIG. 3.

The container support hook 169 includes an L-shaped hook member 178 which is operable in the elevated ball holding position as noted in FIG. 8 to support the front wall section 148 of the container member 130.

USE AND OPERATION OF THE INVENTION

In the use and operation of the invention, we will note the condition of the portable ball retriever, holder, and carrier apparatus 12 in FIG. 1 as being in the ball retriever condition. In this condition, the ball container assembly 20 is in a lowered position adjacent and rearwardly of the ball pick-up assembly 18 and vertically supported on the main support frame assembly 14. The main actuator handle member 158 is rearwardly extended and inclined having the handle member 164 connected to the u-shaped support yoke member 156 by the lock pin assembly 170. This is similar to the locked condition of the actuator handle assembly 22 as shown in FIG. 8 which is in an elevated ball holder condition which will be explained.

In the ball retriever condition of FIG. 1, it is noted that the connector legs 160 of the support yoke member 156 are engagable with the retriever housing stop pins 144. This allows for the operator of the invention to place a downward pressure on the handle grip section 168 which aids in the frictional contact of the wheel members 50 on the support surface 13 which provides the driving force for the ball pick-up assembly 18. This is important as the initial contact of the ball members 15 as noted in FIG. 4 will be between the outer foam cover member 120 and the support surface 13. This is necessary to obtain the initial grasping of the ball members 15 on being moved within the arcuate bottom wall 70 of the main retriever housing 62.

As noted in FIG. 4 in the ball retriever condition, the ball members 15 are moved inwardly as shown in dotted lines and moved upwardly by contact with the foam cover member 120 whereupon they are moved through a ball opening 149 in the front wall section 148 of the container member 130.

Next, after the ball members 15 have been picked up and placed within the container member 130, the operator may wish to place the container member in either (1) the transport or storage condition with the actuator handle assembly 22 in the folded condition; or (2) in the elevated ball holder condition as noted in FIG. 8.

On referring to FIG. 8 in the elevated ball holder condition, it is seen that the container member 130 is movable upwardly from the main support frame assembly 14. The container support arm members 134 are pivoted upwardly with the container member 130 maintained with the bottom wall section 146 in a horizontal plane to prevent spilling of the ball members 15 therefrom. Concurrently, the actuator handle assembly 22 is pivoted to a forward position as noted in FIG. 8. In this position, the forward portion of the front wall section 148 of container member 130 is operable to engage the container support hook 169 so as to provide support.

In this elevated ball holder condition of FIG. 8, it is further noted that the support end strap member 140 of the container support assembly 128 is engagable with the horizontal wall section 76 of the arcuate top wall member 68 of the main retriever housing 62. This, along with the use of the container support hook 169, is operable to hold the entire container member 130 as shown in FIG. 8. In this condition, it is obvious that, for example, a tennis player can stand next to the portable ball retriever, holder, and carrier apparatus 12 in order to grasp and receive ball members 15 therefrom to practice volley or serving adjacent with the ball members 15 held in a convenient adjacent elevated position.

Additionally, the portable ball retriever, holder, and carrier apparatus 12 is movable into a collapsed or folded condition for (1) the ease of transport in the trunk of a vehicle; or (2) storage purposes in a compact condition. On referring to FIG. 3, portable ball retriever, holder, and carrier apparatus 12 is first moved from the ball retriever condition of FIG. 1 by the removing the lock pin member 172 from the connector tee section 166 and moving the actuator handle assembly 22 to the folded condition as noted in dotted lines in FIG. 3. At this time, the container member 130 is supported on the main support frame assembly 14.

Next, the lock pin member 172 is inserted within aligned holes in the connector tee section 166 and the top yoke section 162 to anchor the actuator handle assembly 22 in the condition as shown in dotted lines in FIG. 3. This allows for the easy grasping of the actuator handle member 158 and transfer of the entire portable ball retriever, holder, and carrier apparatus 12. This folded condition is ideal for storage purposes or conveyance in the trunk of a vehicle requiring a minimum amount of space.

It is seen that the portable ball retriever, holder, and carrier apparatus of this invention provides numerous functions such as (1) ball member retrieving; (2) ball member elevated holding; and (3) ball member storage and carrier. The portable ball retriever, holder, and carrier apparatus may be constructed of a lightweight, maintenance free, plastic material having a self powered drive assembly operable to grasp ball members on a support surface and move them inwardly and upwardly into a ball container assembly.

It is seen that the portable ball retriever, holder, and carrier apparatus of this invention is illustrated as being used on tennis ball members normally in a tennis practice area. However, it is obvious that the size of this invention can be altered so as to be utilized to pick up various items such as handballs on a handball court; golf balls on a putting green; etc.

It is noted that the portable ball retriever, holder, and carrier apparatus of this invention is lightweight; sturdy in construction; easy to operate; provides a self contained power drive means to perform the ball pick-up functions; and substantially maintenance free.

While the invention has been described in conjunction with preferred specific embodiments thereof, it is to be understood that this description is intended to illustrate and not to limit the scope of the invention, which is defined by the following claims.

I claim:

1. A portable ball retriever, holder, and carrier apparatus operable to pick-up ball members from a support surface, comprising:

(a) a main support frame assembly;

(b) a support and power drive assembly connected to said main support frame assembly to power same;

(c) a ball pick-up assembly driven by said support and power drive assembly;

(d) a ball container assembly mounted on said main support frame assembly to receive ball members therein;

(e) said ball pick-up assembly having a main retriever housing with a pick-up cylinder assembly rotatably mounted therein;

(f) said pick-up cylinder assembly includes a rotatable cylinder member with an outer cover member thereon which is resiliently deformable so as to grasp the ball members against said main retriever housing with deformation of said cover member in order to move the ball members upwardly and laterally;

(g) said container assembly includes a container member pivotally connected through a container support assembly to said ball pick-up assembly;

(h) said container support assembly includes a container support member with one outer end thereof pivotally connected to said container member and another outer end thereof pivotally connected to said main retriever housing; and (i) said container member is pivotally movable from a position adjacent said main support frame assembly to retrieve the ball members to an elevated position for use in an elevated ball holder condition.

2. A portable ball retriever, holder, and carrier apparatus operable to pick-up ball members from a support surface, comprising:

(a) a main support frame assembly;

(b) a ball pick-up assembly secured to said main support frame assembly;

(c) a ball container assembly connected to said main support frame assembly;

(d) said ball pick-up assembly having a main retriever housing with a pick-up cylinder assembly rotatably mounted therein;

(e) said main retriever housing having a main inlet opening to allow the ball members moving therethrough to engage ball pick-up cylinder assembly;

(f) said pick-up cylinder assembly having a rotatable resilient pick-up cylinder member operable to (1) first engage the ball members and move them along the support surface into engagement between said pick-up cylinder member and said main retriever housing; and (2) deform said pick-up cylinder member and through frictional contact move the ball members inwardly, upwardly, and laterally into said ball container assembly;

(g) said ball container assembly having a container member which is pivotally mounted on a container support assembly; and (h) said container member being movable from a first horizontal position adjacent the support surface to receive the ball members for a ball retriever, carrier, and storage function to a second elevated horizontal position for having the ball members therein so as to be readily grasped and accessible by one utilizing the invention;

whereby said container member remains in an upright, ball holding condition on movement from said first horizontal position to said second horizontal position.

3. A portable ball retriever, holder, and carrier apparatus, including:

(a) a ball pick-up assembly having a main retriever housing with a rotatable pick-up cylinder assembly mounted therein;

(b) a power means to support said retriever, holder and carrier apparatus above a support surface and operable on movement thereover to rotate said pick-up cylinder assembly;

(c) a ball container assembly connected and adjacent to said ball pick-up assembly to receive ball members therein;

(d) said pick-up cylinder assembly includes a rotatable cylinder member having an outer resilient surface operable to receive the ball members thereagainst for further holding against the support surface and on further rotation, the ball members are moved into engagement with said main retriever housing and subsequently rearwardly, upwardly, and laterally into said ball container assembly;

(e) an actuator handle assembly includes a support yoke member pivotally connected to said ball pick-up assembly; and (f) said actuator handle assembly (1) is in a rearward position used to push the entire said retriever, holder, and carrier apparatus; (2) is movable to a forward position operable to receive a portion of said ball container assembly thereagainst to hold said ball container assembly in an elevated condition; and (3) said actuator handle assembly is pivotally movable relative to said support yoke member to a folded condition adjacent said ball container assembly for purposes of storage and transport.

4. A portable ball retriever, holder, and carrier apparatus as described in claim 3, including:

(a) said actuator handle assembly being pivotally connected at one end to said main retriever housing and having an actuator handle member pivotally connected to said support yoke member; and (b) a lock means for locking said actuator handle member in a first position for pushing the entire said ball retriever, holder, and carrier apparatus and locked in a second position relative to said support yoke member wherein said actuator handle member is folded against said ball container assembly for transporting or storing said ball retriever, holder, and carrier apparatus.

5. A portable ball retriever, holder, and carrier apparatus operable to pick-up ball members from a support surface, comprising:

(a) a main support frame assembly;

(b) a ball pick-up assembly secured to said main support frame assembly;

(c) a ball container assembly connected to said main support frame assembly;

(d) said ball pick-up assembly having a main retriever housing with a pick-up cylinder assembly rotatably mounted therein;

(e) said main retriever housing having a main inlet opening to allow the ball members moving therethrough to engage said ball pick-up cylinder assembly;

(f) said pick-up cylinder assembly having a rotatable resilient pick-up cylinder member operable to (1) first engage the ball members and move them along the support surface into engagement between said pick-up cylinder member and said main retriever housing; and (2) deform said pick-up cylinder member and, through frictional contact, move the ball members inwardly, upwardly, and laterally into said ball container assembly;

(g) said ball container assembly having a container member which is mounted on a container support assembly;

(h) said container member being movable from a first horizontal position adjacent the support surface to receive the ball members for a ball retriever, carrier, and storage function to a second elevated position for having the ball members therein so as to be readily grasped and accessible by one utilizing the invention;

(i) a support power drive assembly connected to said main support frame assembly including a support shaft connected to a wheel member which is rotatable on engagement of said wheel member with the support surface and operable through a power drive assembly to transfer rotational movement of said support shaft to said ball pick-up assembly to achieve rotation of said pick-up cylinder assembly;

(j) an actuator handle assembly including a support yoke member pivotally connected to said ball pick-up assembly and having an actuator handle member connected thereto; and (k) said support yoke member (1) is in a rearward position used to push the entire said retriever, holder, and carrier apparatus; (2) is movable to a forward position wherein said support yoke member is able to receive a portion of said ball container assembly thereagainst to hold said ball container assembly in an elevated condition; and (3) said actuator handle member is pivotally movable relative to said support yoke member to a folded condition adjacent said ball container assembly for purposes of storage and transport.

6. A portable ball retriever, holder, and carrier apparatus, including:

(a) a ball pick-up assembly having a main retriever housing with a rotatable pick-up cylinder assembly mounted therein;

(b) a power means to support said retriever, holder, and carrier apparatus above a support surface and operable on movement thereover to rotate said pick-up cylinder assembly;

(c) a ball container assembly connected and adjacent to said ball pick-up assembly to receive ball members therein;

(d) said pick-up cylinder assembly includes a rotatable cylinder member having an outer resilient surface operable to receive the ball members thereagainst for holding against the support surface and, on further rotation of said cylinder member, the ball members are moved into engagement with said main retriever housing and subsequently rearwardly, upwardly, and laterally into said ball container assembly;

(e) an actuator handle assembly being pivotally connected at one end to said main retriever housing and having an actuator handle member pivotally connected to a support yoke member:

(f) said actuator handle member having a lock pin assembly for locking said actuator handle member in a first position for pushing the entire said ball retriever, holder, and carrier apparatus;

(g) said actuator handle member may be locked in a second position by said lock pin assembly with said actuator handle member folded against said ball container assembly for transporting or storage of said portable ball retriever, holder, and carrier apparatus;

(h) said actuator handle member including a support hook mounted thereon;

(i) said actuator handle member being pivotal to a forward position and said ball container assembly being pivotal to an elevated position; wherein (j) said ball container assembly is connected to said support hook to hold same in the elevated position.

7. A portable ball retriever, holder and carrier apparatus as described in claim 3, wherein:

(a) said ball container assembly includes a container member pivotally connected by a container support assembly to said main retriever housing: and (b) said container support assembly having stop pins mounted on said main retriever housing engageable with said actuator handle assembly when in said rearward position to apply a downward force against said ball pick-up assembly on applying a pushing force against said actuator handle assembly to aid in grasping and moving the ball members rearwardly and upwardly.

8. A portable ball retriever, holder and carrier apparatus as described in claim 3, wherein:

(a) said ball container assembly includes a container member pivotally connected by a container support assembly to said main retriever housing;

(b) said container support assembly having container support members pivotally connected to and mounted between said container member and said main retriever housing; and (c) said container support members being pivotal from a first generally horizontal position to hold said container member in a first horizontal position adjacent the support surface to receive the ball members to a second elevated vertical position for a ball holding function.

9. A portable ball retriever, holder and carrier apparatus as described in claim 8, wherein:

(a) said container support assembly further includes a cross support member secured to said container support members and engageable with said main retriever housing in the second elevated position to provide support to said container member.

10. A portable ball retriever, holder, and carrier apparatus as described in claim 2, wherein:

(a) an actuator handle assembly is pivotally connected to said ball pick-up assembly; and (b) said actuator handle assembly (1) is in a rearward position used to push the entire said retriever, holder, and carrier apparatus; (2) is movable to a forward position operable to receive a portion of said ball container assembly thereagainst to hold said ball container assembly in an elevated condition; and (3) said actuator handle member is pivotally movable relaive to said support yoke member to a folded condition adjacent said ball container assembly for purposes of storage and transport.

11. A portable ball retriever, holder, and carrier apparatus as described in claim 2, wherein:

(a) an actuator handle assembly is pivotally connected to said ball pick-up assembly;

(b) said actuator handle assembly having a container support member mounted thereon;

(c) said actuator handle assembly being pivotal to a forward position and said ball container assembly being pivotal to the second elevated position; and (d) said ball container assembly connected to said container support member to hold same in the second elevated position.

12. A portable ball retriever, holder, and carrier apparatus as described in claim 2, wherein:

(a) an actuator handle assembly is pivotally connected to said ball pick-up assembly; and (b) said actuator handle assembly being engageable with a portion of said container support assembly to apply a forward and downward force on said ball pick-up assembly when in a ball retriever function.

* * * * *